US010280652B2

(12) United States Patent
LaPray

(10) Patent No.: US 10,280,652 B2
(45) Date of Patent: May 7, 2019

(54) SYSTEMS AND DEVICES FOR SECURING PORTABLE OBJECTS AND RELATED METHODS

(71) Applicant: Jon LaPray, Lincoln, CA (US)

(72) Inventor: Jon LaPray, Lincoln, CA (US)

( * ) Notice: Subject to any disclaimer, the term of this patent is extended or adjusted under 35 U.S.C. 154(b) by 259 days.

(21) Appl. No.: 14/093,378

(22) Filed: Nov. 29, 2013

(65) Prior Publication Data

US 2014/0150215 A1 Jun. 5, 2014

Related U.S. Application Data

(60) Provisional application No. 61/731,485, filed on Nov. 30, 2012.

(51) Int. Cl.

| | |
|---|---|
| ***E05B 73/00*** | (2006.01) |
| *E05B 67/00* | (2006.01) |
| *B61D 45/00* | (2006.01) |

(52) U.S. Cl.

CPC ..... *E05B 73/0005* (2013.01); *B61D 45/001* (2013.01); *E05B 67/003* (2013.01); *E05B 73/00* (2013.01); *Y10T 24/31* (2015.01)

(58) Field of Classification Search

CPC ..... E05B 73/0005; E05B 73/00; E05B 6/006; E05B 67/003; Y10T 24/31; Y10T 29/49948; F16B 41/00; A47F 3/002; B61D 45/001

USPC ..... 248/214, 500, 400, 503, 505, 215, 211, 248/213, 301, 303, 304, 499; 280/163, 280/165, 166; 296/62; 224/403, 405, 224/404

See application file for complete search history.

(56) References Cited

U.S. PATENT DOCUMENTS 18,107 A * 9/1857 Seaman ..... B63B 35/816 114/252
1,321,742 A * 11/1919 Hendricks ..... F16B 43/00 224/42.39

(Continued)

FOREIGN PATENT DOCUMENTS

CA 2344745 A1 * 10/2002 ..... E05B 73/0082
GB 4023108 4/2012

OTHER PUBLICATIONS

Car key lock box photograph.

*Primary Examiner* — Kimberly T Wood
(74) *Attorney, Agent, or Firm* — William K. Nelson; Jared E. Christensen; Mark D. Miller

(57) ABSTRACT

An anchoring device and system for securing portable objects is disclosed. The anchoring device may be configured for engagement with a lockable container or structure having an articulating, lockable member. The system may include an anchoring device and a securing device, the securing device (e.g., a cable, chain, etc.) being configured to engage with portable objects and be secured by the anchoring device. In some aspects, an anchoring device may be for engagement with a lockable vehicle door or tailgate can include one or more anchoring members and at least one restraining member. In some aspects, the securing member may be a cable or chain having a closed loop that can be engaged with a portable object and a restraining portion of the anchoring device, and when the anchoring device is engaged with a lockable container or structure, the portable object may be secured thereto.

22 Claims, 3 Drawing Sheets

(56) References Cited

U.S. PATENT DOCUMENTS 1,447,636 A * 3/1923 White ..... A47G 25/08 211/35
1,516,489 A * 11/1924 Barton ..... B60R 9/00 24/523
1,964,849 A * 7/1934 Gordon ..... F16L 3/00 24/131 R
2,151,510 A * 3/1939 Gorfein ..... D06F 57/127 211/119.8
2,876,729 A * 3/1959 Georgette ..... B63B 17/02 114/218
3,043,550 A * 7/1962 Garbarino ..... B60R 9/00 24/115 K
3,055,333 A * 9/1962 Ryan ..... B63B 21/04 114/210
3,106,377 A * 10/1963 Cotton ..... B60P 7/0807 410/116
3,219,302 A * 11/1965 Smith ..... A47G 1/20 248/218.3
3,259,353 A * 7/1966 Webb ..... B60P 7/0807 24/115 K
3,351,356 A * 11/1967 Clark ..... B60P 7/0807 410/110
3,421,726 A * 1/1969 Getter ..... B60P 7/0807 296/43
3,514,152 A * 5/1970 Hermon ..... B60J 7/141 296/100.07
3,685,778 A * 8/1972 Berns ..... B60P 7/0815 24/580.11
3,704,039 A * 11/1972 Dean ..... B60J 7/1621 296/100.07
4,094,487 A * 6/1978 Heard ..... G09F 7/18 248/230.9
4,248,399 A 2/1981 Gipson
D258,715 S 3/1981 Gipson
4,648,765 A * 3/1987 Kovaleski ..... B61D 45/00 114/218
4,726,499 A * 2/1988 Hoerner ..... B60R 9/06 224/314
4,738,216 A * 4/1988 Camarota ..... B63B 35/815 114/219
4,812,093 A * 3/1989 Millar, Jr. ..... B60P 7/0807 105/390
4,818,162 A * 4/1989 Zukowski ..... B61D 45/001 410/106
4,850,770 A * 7/1989 Millar, Jr. ..... B61D 45/001 410/110
4,957,400 A * 9/1990 Karp ..... B60R 9/04 224/309
4,987,845 A * 1/1991 Camarota ..... B63B 35/816 114/218
5,255,464 A * 10/1993 Marecek ..... G09F 21/048 40/588
5,406,809 A * 4/1995 Igelmund ..... E05B 73/0005 248/552
5,443,341 A * 8/1995 Hamilton ..... B60P 7/0807 24/68 CD
5,547,321 A * 8/1996 Thomas ..... B61D 45/001 105/390
5,566,965 A * 10/1996 Applegate ..... B60D 1/06 280/500
5,787,738 A * 8/1998 Brandt ..... E05B 73/0005 70/14
6,039,520 A * 3/2000 Cheng ..... B60P 7/0807 410/106
6,170,724 B1 * 1/2001 Carter ..... B60R 9/00 220/4.29
6,174,012 B1 * 1/2001 Saffold ..... B60R 9/00 224/404
6,302,365 B1 * 10/2001 Catanzarite ..... A47G 25/0614 248/215
6,409,230 B1 * 6/2002 Entenmann ..... B60P 7/0807 24/129 R
6,499,564 B2 * 12/2002 Puglisi ..... B60R 3/007 182/127
6,722,590 B2 * 4/2004 Kost ..... E01C 19/203 222/166
6,974,058 B2 * 12/2005 Stevenson ..... B60R 9/00 224/403
7,181,807 B2 * 2/2007 Oatway ..... F16G 11/14 24/136 K
7,287,943 B1 * 10/2007 Saward ..... B60R 9/045 410/104
8,028,966 B2 * 10/2011 Chen ..... A47F 5/0006 211/59.1
8,678,726 B1 * 3/2014 Stubbs ..... B60P 3/079 410/23
9,004,521 B2 * 4/2015 Dringenberg ..... B60D 1/52 280/491.4
2008/0185353 A1 * 8/2008 Immerman ..... A47K 10/04 211/16
2009/0184494 A1 7/2009 Dominissini et al.
2009/0278333 A1 * 11/2009 Lopez ..... B60D 1/488 280/495
2011/0064535 A1 * 3/2011 Tardif ..... B60P 7/0807 410/100

* cited by examiner

SYSTEMS AND DEVICES FOR SECURING PORTABLE OBJECTS AND RELATED METHODS

CROSS-REFERENCE TO RELATED APPLICATIONS

This application claims priority of U.S. Provisional Patent Application No. 61/731,485, filed on Nov. 30, 2012, hereby incorporated by reference in its entirety.

FIELD OF THE INVENTION

The present invention relates to devices, systems, and methods for securing portable objects by anchoring them to a larger and/or immovable object. More specifically, the embodiments of the present invention pertain to removable locking devices for securing portable objects in open locations to truck beds, toolboxes, and other objects that can serve as anchors to prevent and/or deter theft of the objects. The present invention also relates to anchoring systems that include one or more removable anchor devices and one or more associated cables that can be threaded through one or more portable objects and engaged with the one more removable anchor devices. Additionally, the present invention relates to methods of securing portable objects by engaging the objects with the removable anchor devices.

DISCUSSION OF THE BACKGROUND

Most toolboxes, storage boxes, or tool cabinets (whether truck mounted or in standalone form) can be locked to secure the contents therein. These devices typically have hinged lids or doors covering an internal storage area of which cannot be accessed without unlocking the lid. For example, conventional toolboxes may include a top lid or a side lid that only be opened when the toolbox is unlocked. Unfortunately many tools, devices, and other valuable portable objects are not of suitable size for placement within lockable toolboxes, and many trucks do not have mounted toolboxes. Nonetheless, a user may desire to secure many of such objects, for example and without limitation, ladders, bicycles, generators, and compressors.

Keyed or combination padlocks with chains can be used to secure large equipment or tools that cannot be stored inside a lockable toolbox or storage unit. For example, a ladder lying in the bed of a truck can be secured therein by placing a chain around one or more rungs and then securing both ends of the chain with a padlock to a mounting point in the truck bed. These solutions to securing large objects in storage area, like a truck bed, have disadvantages. For example, padlocks are cumbersome to operate (especially combination padlocks), are relatively easy to lose, and in the case of a combination padlock, requires the user to remember a combination which may be easy to forget. In the case of keyed padlocks, a key is required, which must be retained by the user and which may be misplaced or lost.

It is therefore desirable to have new devices, systems, and methods for securing large equipment and tools, and other bulky objects in truck beds and other open storage areas.

SUMMARY OF THE INVENTION

The present invention concerns anchor devices and securing systems for securing objects in open storage areas or structures. The anchor devices and systems described herein may prevent large equipment and tools from being removed or stolen from such open storage areas or structures. The present invention also concerns methods of using such anchor devices and systems. The anchor devices, securing systems, and methods described herein provide a convenient means of preventing theft of expensive equipment and tools, bicycles, personal vehicles, and other bulky objects.

The anchoring devices of the present invention may be configured to engage with toolboxes, tailgates, and other lockable structures. The anchoring devices are designed to engage with and be held in place in a lockable structure (e.g., a tailgate, toolbox lid, etc.) when the lockable structure is in its locked condition. Implementations in accordance with some embodiments of the present invention include an anchoring device having a restraining portion for engaging with a cable, chain, or other securing device, and an anchor portion for securing the anchoring device in a lockable structure. For example, and without limitation, in some implementations the anchoring device may be configured to be secured in a toolbox between a sidewall of the toolbox and a lid or door of the toolbox. In such implementations, the anchor portion of the anchoring device may have one or more hook-like (or hanger-like) anchoring members that can engage with a sidewall of a toolbox, and that may be "pinned" or "sandwiched" in position when the lid of the toolbox is closed over them. In other implementations, the anchor portion may be configured to be secured between a gate (e.g., a tail gate) and a wall of an open-top cargo area of a vehicle or trailer (e.g., a truck bed). In such implementations, anchoring portion may have a shape (e.g., an L-shape or approximate L-shape) that corresponds to a gap at an interface between the base of the gate and the end of bed or open-top cargo area, allowing the anchor portion to be secured between the gate and the bed when the gate is closed. It will be understood that the scope of the present invention encompasses additional variations on the anchoring portion of the anchoring device.

The restraining portion of the anchoring device may be configured to engage with and restrain a securing device that has a closed loop (e.g., a cable having at least one closed loop). In some implementations, the restraining portion may include two parallel bars connected by a cross bar, where the restraining portion creates a closed loop that can lock a securing device (also having its own closed loop) in place when the anchoring device is engaged with a lockable container, a tailgate, etc. In other implementations, the restraining portion may have T-shaped or related structure (e.g., Y-shaped, arrowhead, bulb, etc.) that is wide enough to restrain a closed loop of a securing device in a particular range of sizes. For example, and without limitation, restraining portion may have a T-shape comprised of metal bars, where the cross bar is sufficiently long to restrain closed loops having a particular size (pitch), or a padlock of any practical size. It will be understood that the scope of the present invention encompasses additional variations on the restraining portion of the anchoring device.

The present invention also concerns a securing system that includes the anchoring device described herein and a securing device that can be engaged with the anchoring device and moveable objects, such as large equipment and tools, etc., thereby securing such objects. The securing device may be a cable or other elongate device having at least one closed loop. The securing device may be engaged with one or more portable objects and can be engaged with any implementation of the anchoring device of the present invention. In some implementations, the securing device is a smooth cable having a closed loop at each end thereof, where the closed loops are configured to be engaged with the anchoring device.

The securing system of the present invention can be utilized in the bed of a truck, trailer, or other vehicle, or in other open storage areas to secure large or awkwardly shaped portable objects that cannot be otherwise secured in a toolbox or other closed storage area. The securing device can be threaded through open areas of the object that provide a useable engagement point (e.g., closed areas of a bike frame, closed-loop handles on a generator, etc.). The securing device may then be engaged with one or more anchoring devices of the present invention. The anchoring devices may then be secured in a closable articulating lockable structure (e.g., a tailgate), thereby securing the moveable objects in the open storage area.

Some embodiments of the present invention relate to a securing system for engaging with a storage structure having a closable member and a wall adjacent to the closeable member, where the system includes a securing device for securing portable objects, where the securing device has at least one closed loop; and an anchor device configured to be engaged with the securing device, and the anchor device includes a restraining portion for engaging the closed loop of the securing device and an anchor portion fixed to the restraining portion and having a shape that corresponds to an interface of the storage structure wall and the closable member. The storage structure may be a closed storage container (e.g., a toolbox or other container having a lockable lid) or an open storage container having a closeable member (e.g., a truck or trailer bed having a lockable gate). The securing device may be a cable or chain having closed loops at each end thereof.

In some embodiments, the present invention also relates to securing system including an anchor device for engaging with an open-top cargo area of a vehicle or trailer having an articulating member and a wall or surface adjacent to the articulating member, where the anchor device may include: an anchoring portion having at least one anchoring member having a first section, a second section continuous with the first section, and a shape corresponding to an interface between the articulating member and the wall of said open-top cargo area; and a restraining portion fixed to the first section of the anchoring member for restraining a device having a closed loop. The open-top cargo area may be a bed of a truck or trailer and the articulating member may be an articulating tailgate attached to the bed. The wall of the open-top cargo area may be the vertical surface at the end of the truck or trailer bed that is adjacent to the tailgate when the tailgate is in a closed position. The first and second sections of the at least one anchoring member may form an L-shape or an approximate L-shape, which may correspond to a gap at the interface of articulating member and the wall of the open-top cargo area. The at least one anchoring member may be configured such that the second section thereof is position below the articulating member when the anchoring device is engaged with the articulating member and the articulating member is in a closed position, thereby holding the anchoring device fast in the gap at the interface between the articulating member and the adjacent wall of the open-top cargo area. The system may also include a securing device (e.g., a cable or chain) having at least one closed loop (e.g., a closed loop at each end thereof).

In some implementations, the anchoring device may have two or more anchoring members connected by the anchoring portion of the anchoring device. In such implementations, the two or more restraining members may be about parallel from an overhead view (e.g., looking down into the open-top cargo area with the anchoring device "in position," meaning placed in the interface between the articulating member and the adjacent wall of the open-top cargo area). Also, from a side view (e.g., horizontal view along the interface of the articulating member and the adjacent wall of the open-top cargo area, with the anchoring device in position), the two or more anchoring members may be about aligned such that the angle between the first and second sections is about the same for each of the two or more anchoring members. The angle between the first and second sections of each anchoring member may be in a range from between about 60° and about 140° (e.g., between about 70° and about 110°, between about 80° and about 100°, about 90°, or any value or range of values therein).

In some implementations, the restraining portion may include a two lateral bars and a cross between the two lateral bars. In such implementations, one of the lateral bars of the restraining portion may be connected to one of the anchoring members and the other lateral bar may be connected to the other anchoring member. Thus, the anchoring device may, in some implementations, include two lateral structures, each including an anchoring member connected to a parallel bar of the retraining portion, that are connected by the cross bar of the restraining portion. In further implementations, the restraining device may have more than two parallel bars and two or more cross bars, and the anchoring portion may have more than two anchoring members (e.g., a W-like structure).

In some implementations, the restraining portion may have a first longitudinal section and at least two lateral sections that protrude from about the same point on the longitudinal section. The two lateral sections may each protrude at an angle in a range of between about 30° to about 150° (e.g., between about 45° to about 135°, between about 60° to about 120°, about 90°, or value or range of values therein). In such implementations, the restraining portion may create a number of shapes for restraining securing device having a closed loop (e.g., a Y-shape, a T-shape, an arrow head-shape, etc.). The restraining portion may also have more than two lateral sections or other structures capable of restraining a securing device having a closed loop. In such implementations, the anchoring portion of the anchoring device may have one anchoring member.

In some embodiments, the invention relates to a securing system including an anchor device for engaging with a container having an articulating member and a wall adjacent to the articulating member, where the anchor device includes an anchoring portion having at least one anchoring member that has at least three sections: a first section, a second section fixed to the first section and having a first angle relative to the first section, a third section fixed to the second section and having a second angle relative to the second section, where together the first, second, and third sections have an approximate hook shape configured to engage with the wall of the container; and a restraining portion fixed to the first section of the anchoring member for restraining a device having a closed loop. The container may be a closable container and the articulating member may be a closable lid thereto. The anchor device may be configured such that when it is engaged with the container (e.g., a sidewall of the container), the third section of the anchor member is positioned adjacent to an interior surface of the wall of the container, the second section is positioned adjacent to an upper edge of the wall of the container and an inside bottom surface of the articulating member, and the first section of the anchor member is positioned adjacent to an outside surface of the wall of the container. The system may also include a securing device (e.g., a cable or chain) having at least one closed loop (e.g., a closed loop at each end thereof).

In some implementations, the anchoring device may have two or more anchoring members connected by the restraining portion of the anchoring device. In such implementations, the two or more anchoring members may be about parallel from an overhead view (e.g., looking down into the container with the anchoring device "in position," meaning placed on the wall of the container such that the anchor members are placed over the wall). Also, from a side view (e.g., horizontal view along the wall of the container, with the anchoring device in position), the two or more anchoring members may be about aligned such that the first angle between the first and second sections is about the same for each of the two or more anchoring members, and the second angle between the second and third sections is about the same for each of the two or more anchoring members. The first and second angles may both be in a range between about 80° and about 100° (e.g., about 90°, or any value or range of values therein).

In some implementations, the restraining portion may include a two lateral bars and a cross bar between the two lateral bars. In such implementations, the anchoring device may have two anchoring members, and one of the lateral bars of the restraining portion may be connected to one of the anchoring members and the other lateral bar may be connected to the other anchoring member. Thus, the anchoring device may, in some implementations, include two lateral structures, each including a hook-like anchoring member connected to a parallel bar of the retraining portion, that are connected by the cross bar of the restraining portion. In further implementations, the anchoring device may have more than two parallel bars and two or more cross bars, and the anchoring portion may have more than two anchoring members (e.g., a W-like structure).

In some implementations, the restraining portion may have a first longitudinal section and at least two lateral sections that protrude from about the same point on the longitudinal section. The two lateral sections may each protrude at an angle in a range of between about 30° to about 150° (e.g., between about 45° to about 135°, between about 60° to about 120°, about 90°, or value or range of values therein). In such implementations, the restraining portion may create a number of shapes for restraining securing device having a closed loop (e.g., Y-shape, a T-shape, an arrow head-shape, etc.). The restraining portion may also have more than two lateral sections, or some other structure capable of restraining a securing device having a closed loop. In such implementations, the anchoring portion of the anchoring device may have one anchoring member.

The present invention also relates to methods of restraining moveable objects in a storage area having a first wall and a second articulating wall, including the steps of (1) passing a securing device having at least one closed loop through at least one portion of the portable object; (2) threading an anchor device through the at least one closed loop of the securing device, where the anchor device includes a restraining portion for engaging and restraining the securing device and the distal end of the restraining portion has a shape preventing the closed loop of the securing device from being removed from the distal end of the restraining portion, and an anchor portion fixed to the restraining portion; (3) engaging the anchor device with the storage structure or area by positioning the anchor portion in an interface between the first wall and the second articulating wall of the storage area; and (4) engaging the second articulating wall to the first wall, thereby securing the anchor device in the storage area. In such embodiments, the securing device may be a cable or chain having a closed loop therein (e.g., at each end thereof), and the cable or chain may be passed through portions of the moveable objects that create closed loops (e.g., a closed-loop handle on a generator, the space between rungs on a ladder, a closed loop created by the frame of a bicycle, etc.), thereby preventing the cable or chain from being removed from the moveable object when the cable or chain is restrained by the anchor device.

In some implementations, the second articulating wall is a gate (e.g., tailgate) of an open-top cargo area (e.g., a bed) of a vehicle or trailer and the first wall or surface may be a vertical surface or wall of the bed adjacent to the base of the gate. The anchor portion may have an approximate L-shape configured to fit within a gap at the interface between the gate and the vertical wall or surface of the bed adjacent to the base of the gate.

In some implementations, the first articulating wall is the sidewall of a box (e.g., toolbox) and second articulating wall is a lid or door of the box. In such embodiments, the anchor device may have an anchor portion that comprises one or more hook-shaped anchor members for engaging with a sidewall of the box, and the anchor portion may be configured to be pinned between the lid and the box when the lid is in a closed position.

It is an object of the present invention to provide an improved securing system for securing moveable objects in the open cargo or storage areas, such as beds of vehicles and trailers.

It is another object of the present invention to provide a convenient and effective means for securing large objects that cannot fit in typical vehicle-mounted toolboxes.

It is another object of the invention to provide a convenient and effective securing system that can be locked into position by a lockable tailgate.

It is another object of the invention to provide a convenient and effective securing system that can be locked into position by a lockable toolbox, tool closet, or other lockable container.

It is another object of the invention to provide a convenient and effective securing system that can be used to lock large moveable objects in an open storage area without the need of padlock or other extraneous locking mechanism other than a tailgate or a mounted toolbox.

It is another object of the invention to provide a convenient and effective securing system that can be easily stored (e.g., within a toolbox) and has no moving parts.

It is another object of the invention to provide a securing system that includes a smooth, strong, light-weight cable that may prevent or reduce damage that may be caused by heavy chains or coarse cables.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION OF THE EXEMPLARY EMBODIMENTS

Figure 1:
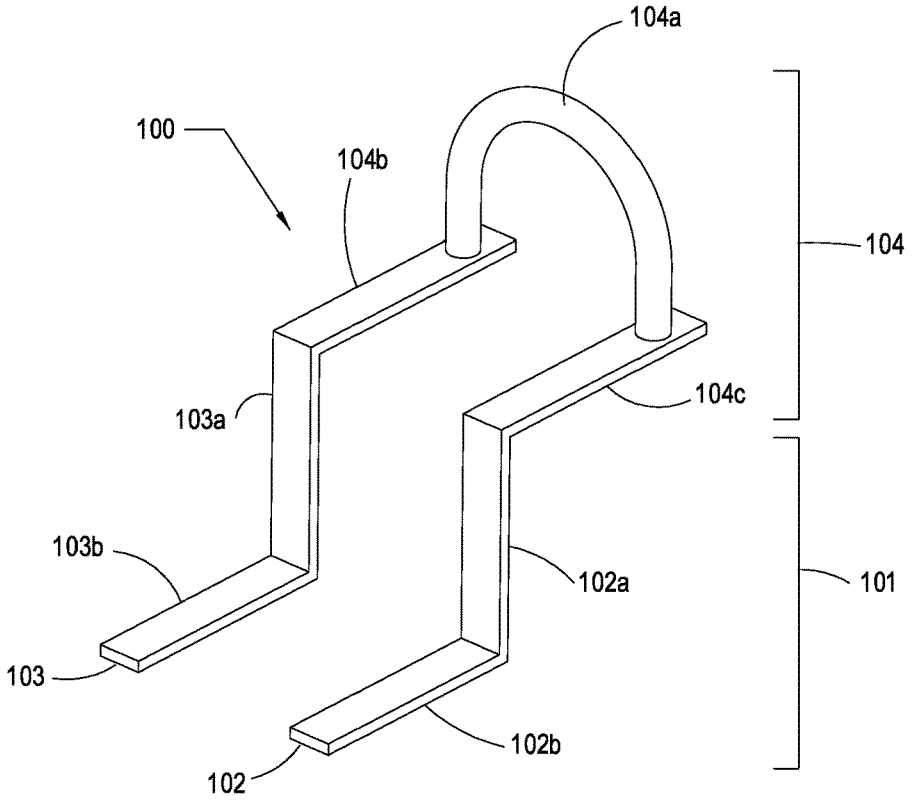
FIG. 1 shows a perspective view of an exemplary anchor device according to some embodiments of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without these specific details.

The present application includes the terms "storage structure," "storage area," "open-top cargo area", and variations thereof describing the kinds of open spaces in which the securing system of the present invention may be used. These terms are meant for illustrative purposes and are not meant to limit the scope of the invention in any way. It is to be appreciated that, unless otherwise specifically required, the terms "horizontal," "vertical," "front," "back," "top," "overhead," "side," and "bottom" are in reference to the anchor device as it would be position when engaged for use on a storage structure (e.g., a toolbox or truck bed). The term "medial" as used herein means situated at or near a midline of a structure (when viewing a front of the structure), the term "lateral" as used herein means situated away from a midline of a structure and near or at outer edge, the term "proximal" as used herein means nearest or closest, and the term "distal" as used herein means furthest, however these terms are also given their ordinary meaning. The terminology discussed in this paragraph is not meant to limit the scope of the invention, but rather is used for convenience in referring to the exemplary illustrations.

The present invention concerns systems for securing portable objects in an open storage area or structure and methods of using the same. Such systems may have one or more anchor devices for engaging with a closable, lockable structure and a securing device that can be engaged with the portable objects and the one or more anchor devices. In some embodiments, the anchor devices are configured to engage with a closable, articulating member (e.g., a gate) of an open-top storage area of vehicle or trailer. In some embodiments, the anchor devices are configured to engage with a closable, lockable container (e.g., a toolbox). In still other embodiments, the securing system may include one or more anchor devices that are configured to engage with a closable, articulating gate of an open-top storage area of vehicle or trailer, and one or more anchor devices that are configured to engage with a closable, lockable container (e.g., a toolbox). Various embodiments of the anchor devices are discussed below in detail.

The securing system of the present invention may include one or more securing device(s), which may be a cable, chain, or similar device. The securing device may have at least one closed loop. In some embodiments, the securing device may be a cable having a closed loop at each end thereof, the closed loops being configured to be placed around the anchor device such that when the anchor device is engaged with a lockable structure (e.g., a tailgate or toolbox) the closed loops cannot be removed from the anchor device. The securing device of the present invention may be a single non-branch cable or chain, or it may have one or more branches, allowing it to be engaged with a plurality of anchor devices. The securing devices of the present invention may be configured to be passed through open portions of objects to be secured (e.g., through closed loop created by the head tube, down tube, and seat tube of a typical bicycle, or a closed loop handle on a generator, through the rungs of a ladder, etc.), and engaged with a securing portion of at least one anchor device. Closed loops at the ends of the cable may be threaded over the one or more anchor devices, which can then be locked in place by a tailgate and/or a toolbox, thereby securing the equipment, tools, or other objects. The securing device (e.g., a cable or chain) may comprise a strong durable material, such as nylon or high density polyethylene, and may include stranded or braided synthetic fibers (such as the braided fibers the Kevlar® branded product). In other embodiments, the securing device may be a braided metal cable that may be coated or have an outer layer of material, the material being a pliable and/or non-abrasive material that prevents or reduces abrasion and damage to moveable object secured by the securing system. It is to be appreciated that other devices may be used as a securing device in combination with the anchor devices of the present invention, for example, and without limitation, a chain having links having a sufficiently large pitch may be used, a chain having a rings at each end that have a sufficiently large diameter to engage with an anchor device may be used, a chain and a padlock may be used, a padlock, etc.

The presently disclosed securing system can be employed to lock up and secure valuable equipment and tools (e.g., bicycles, generators, compressors, ladders, etc.) in the bed of a trailer or vehicle in order to prevent theft. The securing system provides a sturdy and convenient means of securing large valuable items in open areas or storage structures.

It is to be appreciated that the securing systems of the present invention may vary in the number and form of the anchor device, and the number and form of the securing devices. The following exemplary embodiments and examples are provided for illustrative purposes and are not intended to limit the scope of the invention.

Exemplary Securing Systems

Systems for Open-Top Cargo Areas

There is a common need to secure bulky objects in an open cargo area (e.g., the bed) of a vehicle such as a truck or trailer. The present invention provides an anchor device that can be engaged with gates or doors to provide an anchoring point for cables, chains, and other securing devices. For example, many conventional truck tailgates may be locked in an upright position, and the present invention provides an anchor lock device that may be inserted into hinged recesses of lockable truck tailgates and locked in position by such tailgates.

In some embodiments of the present invention, the anchor lock device is configured to be engaged with a gate of an open-top cargo area of a vehicle or trailer (e.g., a tailgate of a truck, car, or trailer bed). The anchor lock device may have an anchoring portion and a restraining portion, which may be connected and continuous with one another. The anchoring portion may have a shape that is particularly designed for insertion between a closable, articulating member (e.g., a door, a gate, etc.) and a surface adjacent to the articulating, closable member when the articulating member is in a closed position. The securing portion may be designed to provide a closed-loop structure for engaging with a restraining device (e.g., cable, chain, etc.) when the restraining portion is engaged, thereby providing an anchor to which the securing device can be engaged.

Referring now to the exemplary illustration of FIG. 1, which shows a perspective view of an anchor lock device 100 positioned in an approximately horizontal manner, as it might be if engaged with an open-top cargo area. The anchor lock device 100 may include an anchor portion 101 that includes a first anchoring member 102 having a first section 102*a* and a second section 102*b*, and a second anchoring member 103 having a first section 103*a* and a second section 103*b*. As discussed above, the anchoring members may be inserted into a gap recess at the interface between an articulating, closable member, (e.g., a truck tailgate) and an adjacent wall of an open-top cargo area (e.g., a truck bed) for securement therein. The first and second anchoring members may have shapes that are configured to fit within such interface. For example, and without limitation, the first and second anchoring members 102 and 103 may have an approximate L-shape that is configured to fit in the gap at the interface between the articulating, closable member and the adjacent wall of an open-top cargo area, as shown in FIG. 1. In such implementations, the first sections 102*a* and 103*a* may be positioned at an angle of approximately 90° relatively to the second sections 102*b* and 103*b*, respectively. However, it should be understood that the angle between the first and second sections of each anchoring member may be an angle other than 90°; such angles may be in a range between about 60° and about 140° (e.g., between about 70° and about 110°, between about 80° and about 100°, about 90°, or any value or range of values therein). In some examples, the angle between the first and second sections of the anchoring member should be such that the second section sits beneath a lower surface of a tailgate when the tailgate is in the closed position and prevents the anchor lock from be pulled from the interface between the tailgate and the bed.

It is to be appreciated that variations of the anchoring members are contemplated in accordance with some embodiments of the present invention. In some implementations, the anchoring portion 101 of the anchor device 100 may have additional sections or pieces that may provide additional securement of the anchor device when engaged with an articulating closable member. For example, and without limitation, each of the anchoring member 102 and 103 may have enlargements or additional sections (e.g., bulbs, vertical/downward extensions, etc.) at the distal end of the second sections 102*b* and 103*b* to prevent the anchor device from being pulled or ripped through the interface between the articulating member (e.g., the tailgate) and the open-top cargo area (e.g., the end of the truck bed). The size of the gaps and spaces between gates and beds of various kinds of vehicles and trailers may vary, and enlargements at the distal ends of the anchoring members 102 and 103 may help to prevent the removal of the anchor device from larger gaps. It is further to be appreciated that the shape of the first and second sections of the anchoring members may be of any shape suitable for insertion between the gap of the articulating member and the open-top cargo area. For example and without limitation, the sections may have a "bar" shape (as illustrated in FIG. 1), a curved shape, or any other shape.

The restraining portion of the anchor device is configured to engage securing devices having a closed loop, allowing such securing devices to be anchored by the anchor device. The exemplary anchor device 100 of FIG. 1 includes a restraining portion 104 having a first bed extension 104*b* and a second bed extension 104*c* connected by a cross bar 104*a*. The bed extensions 104*b* and 104*c* may each be connected to the first sections 102*a* and 103*a* of the anchoring portion 101, respectively. In some implementations, the angle between the first sections 102*a* and 103*a* of the anchoring portion 101 and the bed extensions 104*b* and 104*c* may be about 90°. The cross bar 104*a* may have a curvature (e.g., may be semicircular) to provide clearance from an adjacent surface. For example, and without limitation, the anchor device 100 may be engaged with a tailgate of a truck such that the bed extensions 104*b* and 104*c* rest on the bed of the truck. In such an example, the curvature of the cross bar 104*a* will provide clearance between the cross bar 104*a* and the surface of the truck bed to allow space for a securing device to be placed around the cross bar 104*a*.

It is to be appreciated that the scope of the present invention includes variations on the anchor device and is not limited to the particular implementation shown in FIG. 1. One aspect of variation is the angles between the first sections 102*a* and 103*a* of the anchoring portion 101 and the bed extensions 104*b* and 104*c*. These angles may be in a range of between about 90° and about 180° (or any value or range of values therein). The exemplary anchor device 100 of FIG. 1 illustrates angles between the first sections 102*a* and 103*a* of the anchoring portion 101 and the bed extensions 104*b* and 104*c* of about 90°. However, in other variations, the angles between the first sections 102*a* and 103*a* of the anchoring portion 101 and the bed extensions 104*b* and 104*c* may create clearance between the bed extensions 104*b* and 104*c* and the adjacent surface of the open-top cargo area with which the anchor device is engaged (e.g., angles in a range of between about 120° and 150°). For example, and without limitation, the angles between the first sections 102*a* and 103*a* and the bed extensions 104*b* and 104*c* may be about 135°, providing an angle of about 45° between the bed extensions and the surface of the bed of the open-top cargo area. In such embodiments, the cross bar 104*a* may have no curvature therein. In examples in which the bed extensions 104*b* and 104*c* are at an angle relative to the adjacent surface of an open-top cargo area, the restraining member 104 may be formed of a single continuous (e.g., forged, unwelded) piece of material, for example, in a horseshoe-like shape. In other variations, the cross-bar 104*a* of the restraining member may have some shape protruding outwardly from the anchoring members other than semicircular or curved. For example, and without limitation, the restraining member may have a rectangular, triangular, saw-tooth, piecewise geometry, or other shape.

In another variation, there may be little or no bend between the first sections 102*a* and 103*a* of the anchoring portion 101 and the bed extensions 104*b* and 104*c*. In such variations, the bed extensions may be adjacent to an interior-facing surface of the articulating member (e.g., positioned parallel against the tailgate), and the cross bar 104*a* may have a curvature that creates separation between the cross bar 104*a* and the surface of the articulating member.

Figure 2:
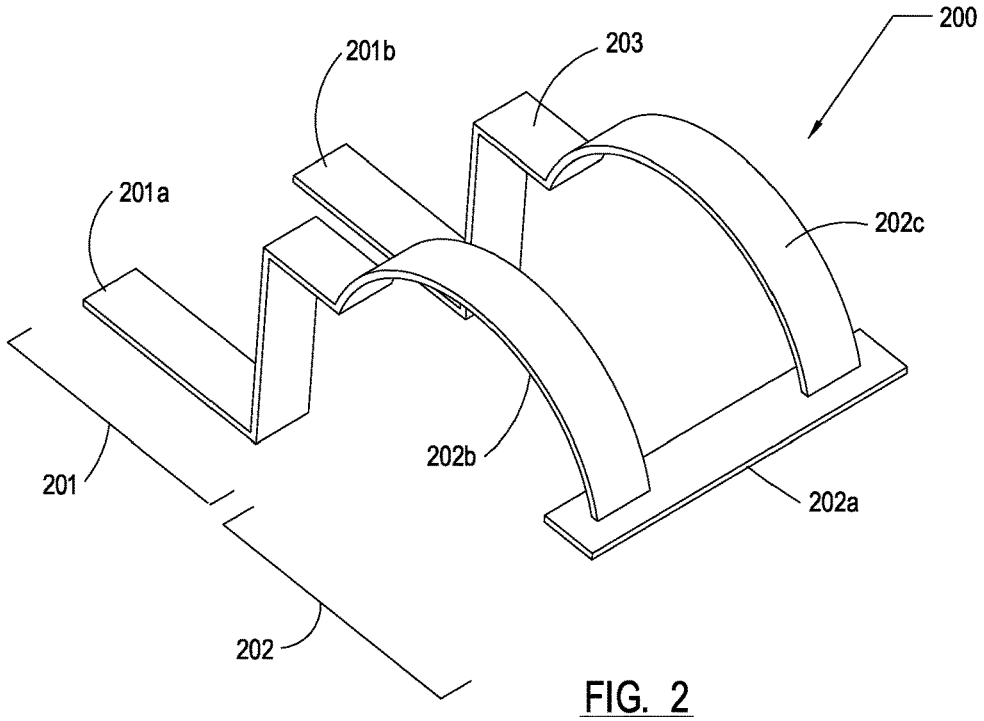
FIG. 2 shows a perspective view of an exemplary anchor device according to some embodiments of the present invention.

In further variations, one or both of the bed extensions may have a curvature therein for creating separation between an adjacent surface of the open-top cargo area and the bed extension. For example, and without limitation, FIG. 2 shows an exemplary anchor device 200 having anchor portion 201 having anchoring members 201*a* and 201*b* connected to bed extensions 202*b* and 202*c* having a curved (e.g., semicircular) portion. In this example, the cross bar 202*a* has no curvature, and the bed extensions 202*b* and 202*c* provide space between the restraining portion 202 and the surface of the open-top cargo area (e.g., truck bed) to allow a securing device to be engaged with the restraining portion 202.

Another point of variation may be the orientation of the anchoring members relative to one another. FIG. 1 shows an exemplary anchor device 100 having anchoring members 102 and 103 that are parallel from an overhead perspective, and aligned from a side perspective. Other variations of the anchor device may have anchoring members that are not parallel or aligned. For example, and without limitation, the anchor device may be configured to be engaged in a back corner of an open top cargo area, where one of the anchoring members is engaged with an articulating member and the floor of the open-top cargo area and the other anchoring member is engaged with the articulating member and a sidewall of the open-top cargo area.

It is to be appreciated that other variations of anchoring members and restraining members are contemplated in accordance with some embodiments of the present invention. In some embodiments, the anchor device may include two or more anchoring members and two or more restraining members. In one example, the anchor device may have three anchoring members connected to two restraining members, in which the anchor device may have two lateral anchor members and a medial anchor member and each restraining member is connected to one of the lateral anchoring members and the medial anchor member (e.g., forming a W-like structure). Additional variations on the number of anchoring members and restraining members are within the scope of the present invention. In some embodiments, the bed extensions may have hinges or joints therein to allow the restraining portion to be lifted for engagement with a securing device, thereby providing additional ease of use.

The anchor devices of the present invention may comprise various material compositions. For example, and without limitation, an anchor device of the present invention may comprise iron, steel, aluminum, or other rigid metals or non-metals (e.g., composite materials). The anchor devices may include an outer buffer or padding material covering the rigid material thereof for protecting the surfaces of the open-top cargo area, to increase friction between the anchor device and the open-top cargo area, and providing some compressibility in the surface anchoring members to accommodate various open-top cargo areas (e.g., beds of different vehicles or trailers), which may have gaps at the interface of the articulating member and the adjacent surface of the open-top cargo area that differ in size. For example, and without limitation, the anchor device may have a rubber material over an interior rigid material. It is to be appreciated anchor locks in accordance with some embodiments of the present invention may be used between the bed and tailgate of a vehicle or trailer. Thus, the thickness of the anchoring members should not hinder the closing of a tailgate of the vehicle or trailer.

As discussed above, the anchor devices of the present invention may also be configured to be threaded through and engaged with a securing device having a closed loop. For example, and without limitation, the anchor devices of the present invention may be configured to be paired with one or more cables each having at least one closed loop. At least one of the anchoring members of the anchor device may have a size (e.g., a width and/or thickness) allowing a closed loop of the securing device to be passed thereover, and allowing the securing device to be engaged with the restraining portion of the anchor device. Subsequently, the anchor device can be placed in the interface between an open-top cargo bed and an articulating, closable member attached thereto. When the articulating closable member is subsequently placed in a closed position, the anchor lock and thus the securing device is anchored in position.

Figure 3:
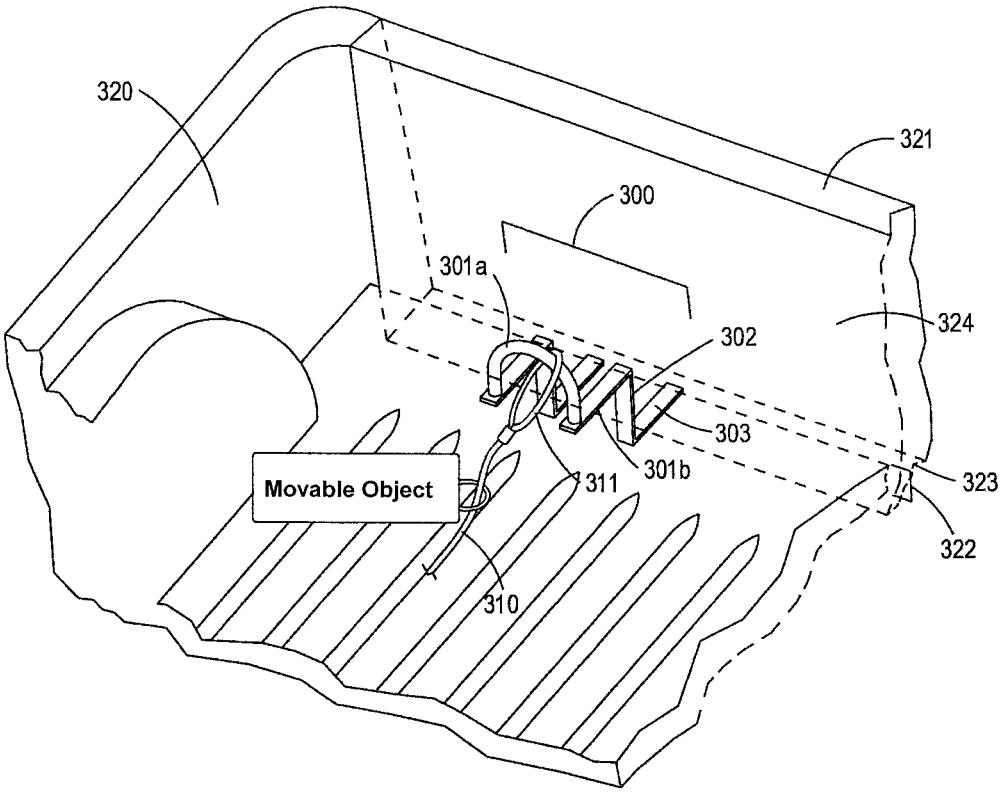
FIG. 3 shows a perspective view of an exemplary securing system according to some embodiments of the present invention, including an anchor device and a securing device.

FIG. 3 provides an example of the securing system for open-top cargo areas, and how the anchor device may engage with the bed of a vehicle and an attached tailgate. FIG. 3 shows a securing system 300 that includes an anchor device 301 and a securing device 310. As illustrated, the anchor device 301 is engaged in a gap at the interface of the bed 320 of the vehicle and a tailgate 321. The anchor portion of the anchor device 301 has a first section (a vertical section) 302 and a second section (a horizontal section) 303. The first section 302 is positioned or "sandwiched" between a vertical surface or wall 322 of the bed 320 and an interior face 324 of the tailgate 321. The second section 303 sits below a bottom surface 323 of the tailgate 321. The engagement of the anchor portion of the anchor device 301 between the bottom surface 323 of tailgate 321 and the surface or wall 322 of the bed 320 holds the anchor device in place, and the position of the second sections 303 below the tailgate 321 prevent the anchor device from being forcibly removed from such position.

Prior to the engagement of the anchor device 301 between the tailgate 321 and the bed 320, a securing device 310 may be engaged with the anchor device 301. The securing device illustrated in the example of FIG. 3 is a cable having a closed loop 311 at one end. The loop 311 may be passed over one of the anchor members of anchor device 301 and engaged with restraining portion 301*a* before the anchor device 301 is engaged between the tailgate 321 and the bed 320. Although for convenience only one closed loop is shown in FIG. 3, the securing device may be a single cable with no branches having closed loops at both ends thereof.

In some embodiments, a system comprising a plurality of anchor devices and/or a plurality of securing devices may be installed onto the truck bed. Inclusion of a plurality of anchor devices may increase the capacity to secure portable items.

Securing Systems for Lockable Containers

In some embodiments of the present invention, the anchor device of such embodiments may be configured to be engaged with a closable container (e.g., a toolbox, a tool closet, etc.) having an articulating closable member (e.g., a lockable lid). The anchor device may have an anchoring portion and a restraining portion, which may be connected and continuous with one another. The anchoring portion may have a shape that is particularly designed for engagement with a wall of the container and to be "pinned" or "sandwiched" between the articulating, closable member and the upper surface of the wall against which the articulating member closes. Thus, when the closable member is closed and locked, it secures the anchor device in position, preventing its removal from the container. The restraining portion may be designed to provide a closed-loop structure when engaged with a closed container, providing an anchor point for a securing device (e.g., cable, chain, etc.) to which the securing device can be engaged.

Figure 4:
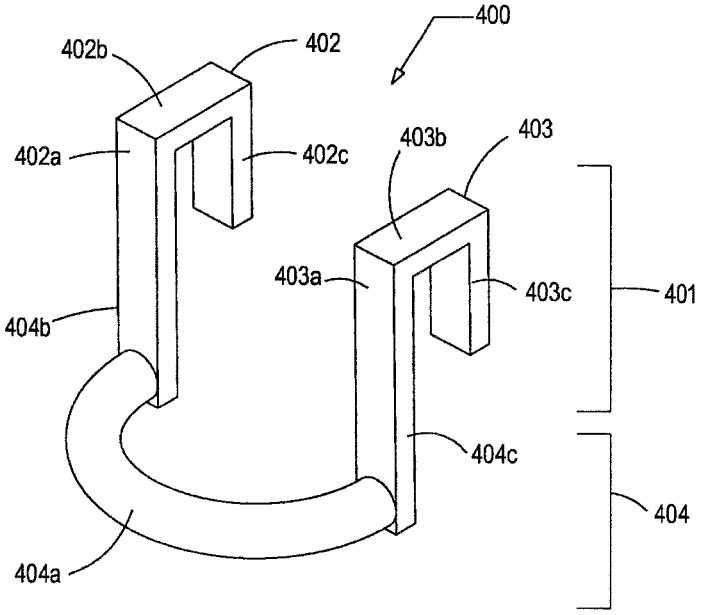
FIG. 4 shows a perspective view of an exemplary anchor device according to some embodiments of the present invention.

Referring now to the exemplary illustration of FIG. 4, which shows a perspective view of an anchor lock device 400 positioned in an approximately vertical manner, as it might be if engaged with a closable container (e.g., a toolbox). The anchor device 400 may include an anchor portion 401 that includes a first anchoring member 402 and a second anchoring member 403. Each of the first and second anchoring members 402 and 403 may have three sections. The first anchoring member 402 may have a first section 402*a*, a second section 402*b*, and a third section 402*c*, and the second anchoring member 403 may have a first section 403*a*, a second section 403*b*, and a third section 403*c*. Each of the anchoring members 402 and 403 may have an approximate hook-like shape, which allows the anchor device 400 to be hung on a vertical wall of a container. In such implementations, the first sections 402*a* and 403*a* may be positioned such that they are adjacent to an exterior vertical surface of a wall (e.g., a sidewall) of the container, the second sections 402*b* and 403*b* may be positioned over an upper, horizontal surface of the wall, and the third sections 402*c* and 403*c* may be positioned adjacent to an interior vertical surface of the wall, such that a vertically opening or swinging lid of the container may be lowered into a closed position over the anchoring members 402 and 403 of the anchor device thereby securing the anchor device 400. However, it should be understood that the anchor device 400 may be positioned in other orientations. For example, and without limitation, the anchor device 400 may be positioned such that the anchoring members 402 and 403 are positioned horizontally, with the second sections 402*b* and 403*b* being positioned adjacent to a side, vertical edge of a wall of a container, such that a horizontally opening or swinging door of the container may be placed in a closed position against the anchoring members 402 and 403 of the anchor device thereby securing the anchor device 400.

It is to be appreciated that variations of the anchoring members are contemplated in accordance with some embodiments of the present invention. In some implementations, the anchoring portion 401 of the anchor device 400 may have additional sections or pieces that may provide additional securement of the anchor device when engaged with a closable container. For example, and without limitation, each of the anchoring member 402 and 403 may have enlargements or additional sections (e.g., bulbs, angled vertical extensions for contacting the underside of a lid, etc.) at the distal end of the third sections 402*c* and 403*c* to prevent the anchor device from being pulled or ripped out of the container. The size of the gaps and spaces between closable containers (e.g., toolboxes) and their closable articulating members (e.g., lids or doors) may vary, and enlargements at the distal ends of the anchoring members 402 and 403 may help to prevent the removal of the anchor device from containers that have larger gaps.

It is to be appreciated that the length of the distal end of the anchoring members may be of a sufficient length to prevent the removal of the anchor device from a container with which it is engaged. For example, and without limitation, the third sections 402*c* and 403*c* may have a sufficient length to prevent removal of the anchor device from the toolbox when the lid is locked in the closed position. In some examples, and without limitation, the third sections 402*c* and 403*c* may have lengths in a range between about two inches and about 10 inches. It is to be appreciated that variations in the size and shape of the anchoring members are contemplated in accordance with some embodiments of the present invention.

Another point of variation in the anchor device may be the orientation of the anchoring members relative to one another. FIG. 4 shows an exemplary anchor device 400 having anchoring members 402 and 403 that are parallel from an overhead perspective, and aligned from a side perspective. Other variations of the anchor device may have anchoring members that are not parallel and aligned. For example, and without limitation, the anchor device may be configured to be engaged in a corner of a container, where one of the anchoring members is engaged with a first sidewall of the container and the other anchoring member is engaged with a second sidewall of the container. Other arrangements of the anchoring members are within the scope of the present invention.

In some embodiments, the restraining portion of the anchor device may be configured to engage securing devices having a closed loop, allowing such securing devices to be anchored by the anchor device. The exemplary anchor device 400 of FIG. 4 includes a restraining portion 404 having a first connecting member 404*b* and a second connecting member 404*c*, which are connected to each other by a cross bar 404*a*. The connecting members 404*b* and 404*c* may each be connected to the first sections 402*a* and 403*a* of the anchoring portion 401, respectively. In some implementations, the angle between the first sections 402*a* and 403*a* of the anchoring portion 401 and the connecting members 404*b* and 404*c* may be about 180°. The cross bar 404*a* may have a curvature (e.g., may be semicircular) to provide clearance from an adjacent surface. For example, and without limitation, the anchor device 400 may be engaged with a wall of a toolbox such that the connecting members 404*b* and 404*c* rest against an outside vertical wall. In such a case, the curvature of the cross bar 404*a* may provide clearance between the cross bar 404*a* and the surface of the vertical wall of the toolbox to allow space for a securing device to be placed around the cross bar 404*a*.

In some implementations, one or both of the connecting members may have a shape that creates separation between an adjacent surface of the wall of the container. For example, and without limitation, one or both of the connecting members may have a curved (e.g., semicircular) portion (e.g., similar to the illustration of FIG. 2). In such examples, the cross bar may have no curvature, and the connecting members provide space between the restraining portion and the surface of the sidewall of the container to allow a securing device to be engaged with the restraining portion. In other implementations, the angle between the connecting members and the first sections of the anchor portion may be less than 180°, thereby creating separation of portions of the restraining member and the wall of the container. For example, and without limitation, the angle at the connection between first section 402*a* and connecting member 404*b*, and the angle at the connection between first section 403*a* and connecting member 404*c* may both be in a range of between about less than 180° and about 30° (e.g., between about 135° and 90°, or a value or range of values therein). In such embodiments, the connecting members and the cross bar may be formed of a single continuous (e.g., forged, unwelded) piece of material, for example, in a horseshoe-like shape.

It is to be appreciated that the anchor device 400 of FIG. 4 is an illustrative example of some embodiments of the invention and that other numbers of anchoring members and restraining members are contemplated in accordance with some embodiments of the present invention. For example, and without limitation, an anchoring lock may include three anchoring members and two restraining members. It is to also be appreciated that the anchoring members may have other geometric configurations for interfacing with other sidewall shapes. For example, and without limitation, the second sections (horizontal portion) of the anchoring members may have semicircular shapes. Additionally, the restraining member may have other positions and orientations relative to the anchoring members. For example, and without limitation, the cross bar may be along a same plane as the connecting members. In some implementations, the cross bar can be welded on ends thereof to one or more connecting members. In some implementations, the cross bar can be unitarily formed with the connecting members (e.g., the connecting members and the cross bar may be formed from a single forged piece of metal having a curvature or bend therein that creates the cross bar). For example, and without limitation, an anchor device can include two anchoring members, two connecting members, and a cross bar that are unitarily formed by bending a single forged metal rod into a horseshoe-like shape.

In some embodiments, the anchor device can formed of iron or other strong and rigid metal. In some implementations, anchor device or portions thereof can be powder coated or coated in a rubberized material for preventing the toolbox from being scratched or dented. However, it is to be appreciated that other materials are contemplated in accordance with some embodiments of the present invention. Other materials and combinations thereof are contemplated in accordance with some embodiments of the present invention.

As discussed above, the anchor locks (e.g., anchor lock 400) of the present invention may also be configured to be threaded through and engaged with a securing device having a closed loop. For example, and without limitation, the anchor devices of the present invention may be configured to be paired with one or more cables each having at least one closed loop. At least one of the anchoring members of the anchor device may have a size (e.g., a width and/or thickness) allowing a closed loop of the securing device to be passed thereover, and allowing the securing device to be engaged with the restraining portion of the anchor device. Subsequently, the anchor device can be placed over a sidewall of a container having a closable, lockable lid or door. When the lid or door is subsequently placed in a closed position, the anchor lock and thus the securing device are anchored in position.

Figure 5:
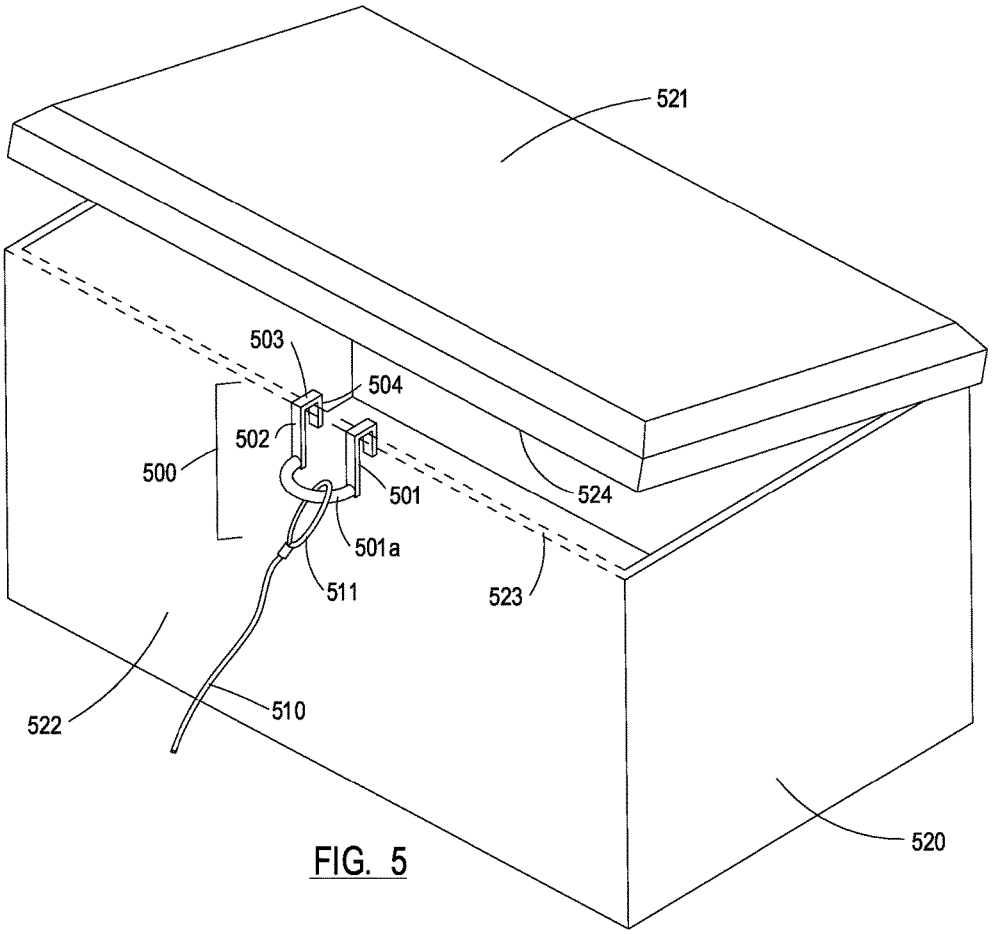
FIG. 5 shows a perspective view of an exemplary securing system according to some embodiments of the present invention, including an anchor device and a securing device.

FIG. 5 illustrates an example of a securing system for lockable containers (e.g., a toolbox, as shown in the figure), and how an anchor device may engage with the sidewall of the container and an attached articulating, closable member (e.g., a lid). FIG. 5 shows a securing system 500 that includes an anchor device 501 and a securing device 510. The anchor device 501 may be engaged with an upper edge 523 of a sidewall 522 of toolbox 520. Each anchor member of the anchor device 501 may include a first section 502 (an exterior vertical section), a second section 503 (a horizontal section), and a third section 504 (an interior vertical section). The first sections 502 are adjacent to an outer surface of sidewall 522, second sections 503 are positioned on upper edge 522 of sidewall 522, and third sections 504 are adjacent to an interior surface of sidewall 522. When a lid 521 is lowered into a closed position, the second sections 503 sit below a bottom surface 524 of the lid 521, and are "sandwiched" between the upper edge 523 of sidewall 522 and bottom surface 524 of the lid 521. The engagement of the anchor portion of the anchor device 501 between the lid 521 and the upper edge 523 of the container 520 holds anchor device in place, and the position of the third sections 504 adjacent to or against the interior surface of sidewall 522 prevent the anchor device from being forcibly removed from such position.

Prior to the engagement of the anchor device 501 between the lid 521 and the sidewall 522, a securing device 510 may be engaged with the anchor device 501. The securing device 510 in the example of FIG. 5 is a cable having a closed loop 511 at one end. The loop 511 may be passed over one of the anchor members of anchor device 501 and engaged with restraining portion 501*a* before the anchor device is engaged between the sidewall 522 and the lid 521. For convenience of explanation, only one closed loop is shown in FIG. 5; however, the securing device may be a single cable with no branches having closed loops at both ends thereof.

In some embodiments, a system comprising a plurality of anchor devices may be installed on a container at the same time. Inclusion of a plurality of anchor devices may increase the capacity to secure a plurality of items. Inclusion of a plurality of anchor locks may also advantageously assist in securing items where opposite ends of a securing device are engaged with different anchor devices disposed along the length of the articulating closable member. The securing system may also include multiple securing devices to accommodate a plurality of moveable objects to be secured by the securing system.

In some embodiments, a securing system in accordance with embodiments of the present invention can be used in connection with a lockable shop tool cabinet, such that large or bulky equipment can be secured to the tool cabinet without requiring the use of additional keyed or combination padlocks.

Additional Anchor Devices

In some embodiments of the present invention, anchor device can have a single anchoring member for engaging with a lockable container or structure, and a restraining member attached thereto. The anchoring member in such embodiments may be configured to engage with a lockable container (e.g., a toolbox) or other lockable storage structure (e.g., a tailgate of an open-top cargo area).

Figure 6:
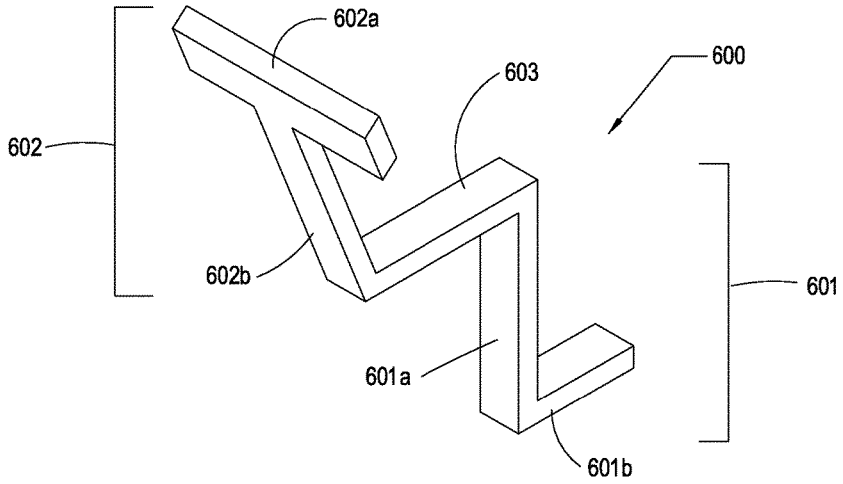
FIG. 6 shows a perspective view of an exemplary anchor device according to some embodiments of the present invention.

Referring now to the exemplary illustration of FIG. 6, the anchor device 600 may be configured to engage with an articulating closeable member (e.g., a gate) of an open-top cargo area of a vehicle or trailer. The anchor device 600 may have an anchoring member 601 which may be similar to the one or more anchoring members discussed above. Anchoring member 601 may have a first section 601*a* and a second section 601*b*, where the first section 601*a* is positioned vertically between a surface of an open-top cargo area and a gate, and the second section 601*b* sits below a bottom surface of the gate when the anchor device 600 is engaged with the gate in a closed position. The restraining member 602 of anchor device 600 may include an axial member 602*b* and a cross bar 602*a*. The restraining cross bar 602*a* may include two lateral sections, each protruding laterally from the axial member at an angle and at substantially the same longitudinal point along the axial member 602*b*. As shown in FIG. 6, the two lateral sections may protrude from an end of the axial member 602*b* at an angle of about 90° relative to axial member 602*b*. However, it is to be appreciated that the invention is not limited to the arrangement of the cross bar 602*a* and axial member 602*b* shown in FIG. 6. For example, and without limitation, the lateral sections of cross bar 602*a* may protrude at an angle of between about 30° to about 120° (e.g., in a Y shape, a T shape, an arrowhead shape, etc.), and may protrude from a point other than an end of the axial member 602*b*. Additionally, the cross bar 602*a* illustrated in FIG. 6 may be replaced by some other structure or configuration having a size and shape capable of restraining a closed loop, such as a bulb, a cone, three or more lateral sections protruding from the axial member 602*b* (e.g., like a grappling hook), etc.

The restraining portion 602 may be connected to the anchoring member 601 by a connecting member 603. The connecting member 603 may extend at an angle of about 90° from the first section 601*a* of the anchoring member. However, in other examples, the connecting member may extend at an angle in a range of between about 90° and about 180° from the first section of the anchoring member. The axial member 602*b* of the restraining portion may be connected to the connecting member 603 and have an angle relative to the connective member 603 to create separation between the restraining portion 602 and a bed of an open-top cargo area (e.g., an angle in a range of between about 15° and about 165°, or any value or range of values therein). In other examples, the connecting member may be absent and the axial member may be connected directly to the first section of the anchoring member, and have an angle relative to the first section to create separation between the restraining member and the bed of the open-top cargo area.

In some embodiments, the anchoring member of the anchor device may be configured to engage with a lockable container, and have a hook-like shape as discussed above in reference to the anchor device of FIG. 4 and similar anchor devices. In such embodiments, the axial member of the restraining portion may be connected to a first section (the section that is adjacent to an exterior of a sidewall of a lockable container) of the anchoring member and may have an angle relative to said first section that creates separation between the restraining member and the exterior surface of the sidewall of the lockable container (e.g., an angle in a range of between about 30° and about 165°, or any value or range of values therein).

The securing device of the present invention may be engaged with the restraining portion of an anchor device. As discussed herein, the restraining device may be a cable or a chain having at least one closed loop. It is to be appreciated that the geometry of the restraining member should be sufficiently larger than that of the closed loop of the cable securing device such that the securing device cannot be removed. In some embodiments, the one or more closed loops of the restraining device may a pitch that is at most widest (e.g., the pitch of the closed loop when it is stretched to a maximum point) that is less than the maximum width of the restraining member (i.e., the distance between lateral most points of the lateral sections, e.g., the tips of the "T").

Method of Use

The present invention also relates to methods of restraining moveable objects in a storage structure or area having a first wall (e.g., a sidewall of a lockable container, or a surface or wall of an open-top cargo area) and a second articulating wall (e.g., a lid or door of a toolbox, or a gate of an open-top cargo area). In addition to the methods disclosed above with reference to the discussion of exemplary devices and systems in accordance with some embodiments of the present invention, a method of the present invention may generally include the steps of (1) passing a securing device (e.g., a cable or chain) having at least one closed loop through at least one portion of the portable object, (2) threading one or more anchor devices (e.g., any of the anchor devices described above) through the at least one closed loop of the securing device, where the anchor device includes a restraining portion for engaging and restraining the securing device and an anchor portion fixed to the restraining portion; (3) engaging the anchor device with the storage structure or area by positioning the anchor portion in an interface between the first wall and the second articulating wall of the storage structure or area; and (4) engaging the second articulating wall to the first wall (e.g., closing the lid of the toolbox or the tailgate), thereby securing the anchor device in the storage structure or area. The cable or chain may be passed through open portions of the portable objects that create closed loops (e.g., a closed-loop handle on a generator, the space between rungs on a ladder, a closed loop created by the frame of a bicycle, etc.), thereby preventing the cable or chain from being removed from the moveable object when the cable or chain is restrained by the anchor device. Once the cable or chain is threaded through the one or more portable objects, the anchor devices may be engaged with a storage structure, and the articulating member of the storage structure may be closed and locked, thereby securing the anchor devices in the storage structure and locking the securing device to the anchor device(s).

It is to be understood that the above method can be implemented with any of the securing systems described herein, and/or any of the anchor devices described herein. For example, and without limitation, the storage structure may be an open-top cargo area of a vehicle or trailer, where the second articulating wall is a gate (e.g., tailgate) of the open-top cargo area (e.g., a truck bed) and the first wall or surface may be a vertical surface or wall of the bed adjacent to the base of the gate. In such implementations, the anchor device may be the same or similar to that as shown in FIG. 1, or one that may be the same or similar to that as shown in FIG. 6. In related implementations, the securing system may have one or more anchor devices that are the same or similar to the one shown in FIG. 1, and/or one or more anchor devices that are the same or similar to the one shown in FIG. 6.

In some implementations, and without limitation, the storage structure may be a container (e.g., a toolbox) and the first wall may be the sidewall of the container and second articulating wall is a lid or door of the container. In such implementations, the anchor device may be one that is the same or similar to the anchor device shown in FIG. 3. In related implementations, the securing system may have one or more anchor devices that are the same or similar to the one shown in FIG. 3.

In some embodiments, the method may include using multiple storage structures and different forms of the anchor device that can be engaged with the various storage structures. In one implementation, the securing system may be used in an open-top cargo area that includes a toolbox or other container mounted therein. In such implementations, one or more anchor devices that are the same or similar to the anchor devices described above in reference to FIG. 3 may be engaged with the toolbox, and one or more anchor devices that are the same or similar to the anchor devices described above in reference to FIG. 1 may be engaged with a gate of the open-top cargo area. In such implementations, one or more securing devices may be engaged with the one or more anchor devices engaged with the toolbox and with the one or more anchor devices engaged with the gate.

It is to be appreciated that a number of different combinations of the anchor devices and securing devices described herein may be used to secure one or more portable objects. It is also to be appreciated that other devices may be used in combination with the anchor devices and/or the securing systems of the present application. For example, padlocks, bike locks, and other devices that are cable of engaging and being secured by the anchor devices of the present invention may be used in combination with the anchor devices.

CONCLUSION/SUMMARY

The present invention thusly provides apparatuses, systems, and methods for securing items to a lockable structure or container, including but not limited to a lockable truck mounted toolbox, a lockable truck tailgate, and a lockable shop tool cabinet. It is to be understood that variations, modifications, and permutations of embodiments of the present invention, and uses thereof, may be made without departing from the scope of the invention. For example, and without limitation, the securing system may include both an anchor device as illustrated in the example of FIG. 1, an anchor device as illustrated in the example of FIG. 3, and/or an anchor device as illustrated in the example of FIG. 6. It is also to be understood that the present invention is not limited by the specific embodiments, descriptions, or illustrations or combinations of either components or steps disclosed herein. Thus, although reference has been made to the accompanying figures, it is to be appreciated that these figures are exemplary and are not meant to limit the scope of the invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed:

1. A method of using a securing system to secure a moveable object in a storage area to prevent theft having a first wall and a second articulating wall, comprising:

a. passing a securing device through at least one portion of said moveable object, said securing device being a continuous unitary structure with no joints or breaks therein and having at least one closed loop on a distal end thereof;

b. threading an anchor device through said at least one closed loop of said securing device, wherein said anchor device has an open loop structure that comprises:

i. a restraining portion for engaging said closed loop of said securing device, and ii. an anchor portion fixed to said restraining portion creating said open loop structure, said anchor portion comprising at least one anchor bar having a first planar portion to which said restraining portion is attached, a second planar portion connected to said first planar portion perpendicular or substantially perpendicular angle to said first planar portion, and a third planar portion connected to said second planar portion perpendicular or substantially perpendicular angle to said second planar portion such that first planar portion and said third planar portion are parallel or substantially parallel, but are on opposite sides of said second planar portion and do not overlap;

c. engaging said anchor device with said storage area by positioning said anchor portion in an interface between said first wall and said second articulating wall of said storage area; and d. placing said second articulating wall in a closed position in close proximity to said first wall, thereby securing said anchor device between said first wall and said second articulating wall in said storage area, wherein said anchor portion has a shape that is complementary to a gap between said first wall and said second articulating wall that is present when said second articulating wall is in said closed position, and said closed loop of said securing device is trapped between said restraining portion and said second articulating wall when said second articulating wall is in said closed position such that said securing device cannot be disengaged from said anchor device and said moveable object cannot be removed from said storage area, wherein said second articulating wall is a gate of an open-top cargo area of a vehicle or trailer and said first wall is a surface adjacent to a base of said gate, and said anchor portion has an approximate L-shape configured to fit within said gap.

2. The method of claim 1, wherein said gap is between the base of said gate and said adjacent surface of said open-top cargo area.

3. The method of claim 1, wherein said restraining portion is a rigid bar connected to said anchor portion.

4. The method of claim 1, wherein said at least one anchor bar comprises a first anchor bar and a second anchor bar, each having a shape that is complementary to said gap between said first wall and said second articulating wall that is present when said second articulating wall is in said closed position.

5. The method of claim 4, wherein said restraining portion is a rigid bar connected said first anchor bar and said second anchor bar.

6. The method of claim 1, wherein said securing device is a cable or chain and said at least one closed loop comprises a first closed loop on a first end thereof and a second closed loop structure on second end thereof, wherein anchor device is threaded through said first closed loop and said second closed loop of said securing device prior to engaging said anchor device with said storage area.

7. A method of using a securing system to secure a moveable object in a storage area having an articulating wall for closing said storage area, comprising:

a. securing a movable object by passing a securing device through a portion of said moveable object, wherein said securing device comprises at least one distal end having a closed loop;

b. passing an anchor device through said at least one closed loop of said securing device, wherein said anchor device comprises:

i. a restraining portion for engaging said securing device, said restraining portion comprising said open loop and at least one extension, and ii. an anchor portion fixed to said restraining portion, said anchor portion comprising at least one anchor bar comprising a first planar section and a second planar section, said second planar section being positioned substantially parallel to, but not overlapping, said at least one extension;

c. engaging said securing system with said storage area by positioning said anchor portion in an interface between said articulating wall and an edge of a stationary wall at an opening of said storage area when said articulating wall is in an open position; and d. placing said articulating wall in a closed position, thereby securing said anchor device between said stationary wall and said articulating wall, wherein said anchor portion has a shape that is complementary to a gap between said stationary wall and said articulating wall that is present when said articulating wall is in a closed position, said second section being adjacent to a side of said articulating wall and not interfacing with said stationary wall, and said at least one closed loop of said securing device is trapped between said restraining portion and said articulating wall when said articulating wall is in said closed position such that said securing device cannot be removed from said restraining portion and said movable object cannot be removed from said storage area, wherein said articulating wall is a gate of an open-top cargo area of a vehicle or trailer and said stationary wall is adjacent to a base of said gate, and said anchor portion has an approximate L-shape configured to fit within said gap.

8. The method of claim 7, wherein said gap is between the base of said gate and said adjacent stationary wall of said open-top cargo area.

9. The method of claim 7, wherein said restraining portion is a rigid bar connected to said anchor portion.

10. The method of claim 7, wherein said at least one anchor bar comprises a first anchor bar and a second anchor bar, each having a shape that is complementary to said gap between said stationary wall and said articulating wall that is present when said articulating wall is in said closed position.

11. The method of claim 10, wherein said restraining portion is a rigid bar connecting said first anchor bar and said second anchor bar.

12. The method of claim 7, wherein said securing device is a cable or chain and said at least one distal end having a closed loop comprises a first end having a first closed loop and a second end having a second closed loop, wherein said anchor device is threaded through said first closed loop and said second closed loop of said securing device prior to engaging said anchor device with said storage area.

13. A method of using a securing system to secure a portable object in a truck bed or trailer bed, comprising:

a. passing a securing device through a portion of said portable object, wherein said securing device has at least one closed loop end;

b. passing an anchor device through said at least one closed loop end of said securing device, wherein said anchor device comprises:

i. a restraining portion for engaging said closed loop end of said securing device, and ii. an anchor portion fixed to said restraining portion operable to be inserted between a tailgate and an edge of said truck bed or trailer bed, and including at least one anchor bar having a shape that is complementary to a gap between said edge of said truck bed or trailer bed and said tailgate that is present when said tailgate is in a closed position;

c. placing said anchor portion of said anchor device in a space between said tailgate and said edge of said truck bed or trailer bed when said tailgate is in an open position; and d. placing said tailgate in said closed position, thereby securing said anchor portion between said tailgate and said edge of said truck bed or trailer bed, wherein said at least one closed loop end of said securing device is trapped between said restraining portion and said tailgate when said tailgate is in said closed position.

14. The method of claim 13, wherein said anchor portion has an approximate L-shape configured to fit within said gap.

15. The method of claim 13, wherein said restraining portion is a rigid bar connected to said anchor portion.

16. The method of claim 13, wherein said at least one anchor bar comprises a first anchor bar and a second anchor bar, each having a shape that is complementary to said gap between said tailgate and said edge of said truck bed or trailer bed.

17. The method of claim 16, wherein said restraining portion is a rigid bar connecting said first anchor bar and said second anchor bar.

18. The method of claim 13, wherein said securing device is a cable or chain and said at least one closed loop end comprises a first closed loop structure on a first end thereof and a second closed loop structure on second end thereof, wherein said anchor device is threaded through said first closed loop and said second closed loop of said securing device prior to placing said anchor device in said space between said tailgate and said edge of said truck bed or trailer bed.

19. The method of claim 13, wherein said portable object is a tool or machinery having a third closed loop structure through which the securing device may be passed.

20. The method of claim 13, wherein said tailgate includes a locking mechanism for locking said tailgate in said closed position.

21. The method of claim 1, wherein said second articulating wall includes a locking mechanism for locking said second articulating wall in said closed position.

22. The method of claim 7, wherein said articulating wall includes a locking mechanism for locking said articulating wall in said closed position.

* * * * *